US007493056B2

(12) United States Patent
Katou

(10) Patent No.: US 7,493,056 B2
(45) Date of Patent: Feb. 17, 2009

(54) IMAGE-FORMING-APPARATUS SIMULATION APPARATUS, IMAGE FORMING APPARATUS SIMULATION METHOD, AND PROGRAM

(75) Inventor: Takashi Katou, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 199 days.

(21) Appl. No.: 11/518,920

(22) Filed: Sep. 12, 2006

(65) Prior Publication Data

US 2007/0237529 A1 Oct. 11, 2007

(30) Foreign Application Priority Data

Apr. 5, 2006 (JP) ..... 2006-103872

(51) Int. Cl.
*G03G 15/00* (2006.01)

(52) U.S. Cl. ..... 399/9; 358/1.15; 399/8; 399/81

(58) Field of Classification Search ..... 399/8, 399/9, 81; 358/1.15, 1.16, 504, 406
See application file for complete search history.

(56) References Cited

U.S. PATENT DOCUMENTS 7,298,501 B2 * 11/2007 Christodoulou et al. 358/1.15 X
2004/0243320 A1 * 12/2004 Chang et al. ..... 702/30

FOREIGN PATENT DOCUMENTS

JP 08-331287 A 12/1996
JP 2002-123383 A 4/2002

OTHER PUBLICATIONS

Translation of JP 08-331287 A dated May 22, 2008.*

* cited by examiner

*Primary Examiner*—Sophia S Chen
(74) *Attorney, Agent, or Firm*—Sughrue Mion, PLLC

(57) ABSTRACT

An image-forming-apparatus simulation apparatus includes a storing section, a first acquiring section, a generating section, a display section and a control section. The storing section stores a defective event table. In the defective event table, event specifying information are associated with image correction rules. Each event specifying information represents a defective event relating to an image forming apparatus. Each image correction rule represents a method for simulating an influence of a defective event on an image formed by the image forming apparatus. The generating section selects at least one image correction rule. The generating unit executes image processing on target image data based on the selected image correction rule to generate defect-image data representing a defect image expected to be formed on a recording medium when the defective event occurs.

18 Claims, 6 Drawing Sheets

FIG. 2

| EVENT SPECIFYING INFORMATION | IMAGE CORRECTION RULE | DEFECT ATTRIBUTE INFORMATION | | |
|---|---|---|---|---|
| | | BLUR | DIRT | MISDRAWING |
| REMAINING AMOUNT OF TONER BEING INSUFFICIENT | FILTER RULE 1 | ○ | – | – |
| DEGRADATION OF PHOTOCONDUCTOR DRUM DEGRADATION | FILTER RULE 2 | ○ | – | ○ |
| DIRT ON IMAGE QUALITY SENSOR | FILTER RULE 3 | ○ | ○ | – |
| ⋮ | ⋮ | ⋮ | ⋮ | ⋮ |

IMAGE-FORMING-APPARATUS SIMULATION APPARATUS, IMAGE FORMING APPARATUS SIMULATION METHOD, AND PROGRAM

BACKGROUND

Technical Field

This invention relates to an image-forming-apparatus simulation apparatus, an image forming apparatus simulation method, and a program for simulating functions provided by an image forming apparatus.

SUMMARY

According to an aspect of the invention, an image-forming-apparatus simulation apparatus includes a storing section, a first acquiring section, a generating section, a display section and a control section. The storing section stores a defective event table. In the defective event table, plural pieces of event specifying information are associated with a plurality of image correction rules. Each of the event specifying information represents a defective event relating to an image forming apparatus. Each of the image correction rules represents a method for simulating an influence of a defective event represented by corresponding event specifying information on an image formed by the image forming apparatus. The first acquiring section acquires target image data. The generating section selects at least one of the image correction rules stored in the storing section. The generating unit executes image processing on the acquired target image data based on the selected image correction rule to generate defect-image data representing a defect image expected to be formed on a recording medium by the image forming apparatus when the defective event, which is represented by event specifying information associated with the selected image correction rule, occurs. The control section displays the generated defect-image data on the display section together with the event specifying information associated with the selected image correction rule.

BRIEF DESCRIPTION OF THE DRAWINGS

Exemplary embodiments of invention will be described in detail based on the following figures, wherein:

FIG. 2 is a schematic representation to show an example of a defective event table stored by the image-forming-apparatus simulation apparatus according to the exemplary embodiment of the invention;

DETAILED DESCRIPTION

Figure 1:
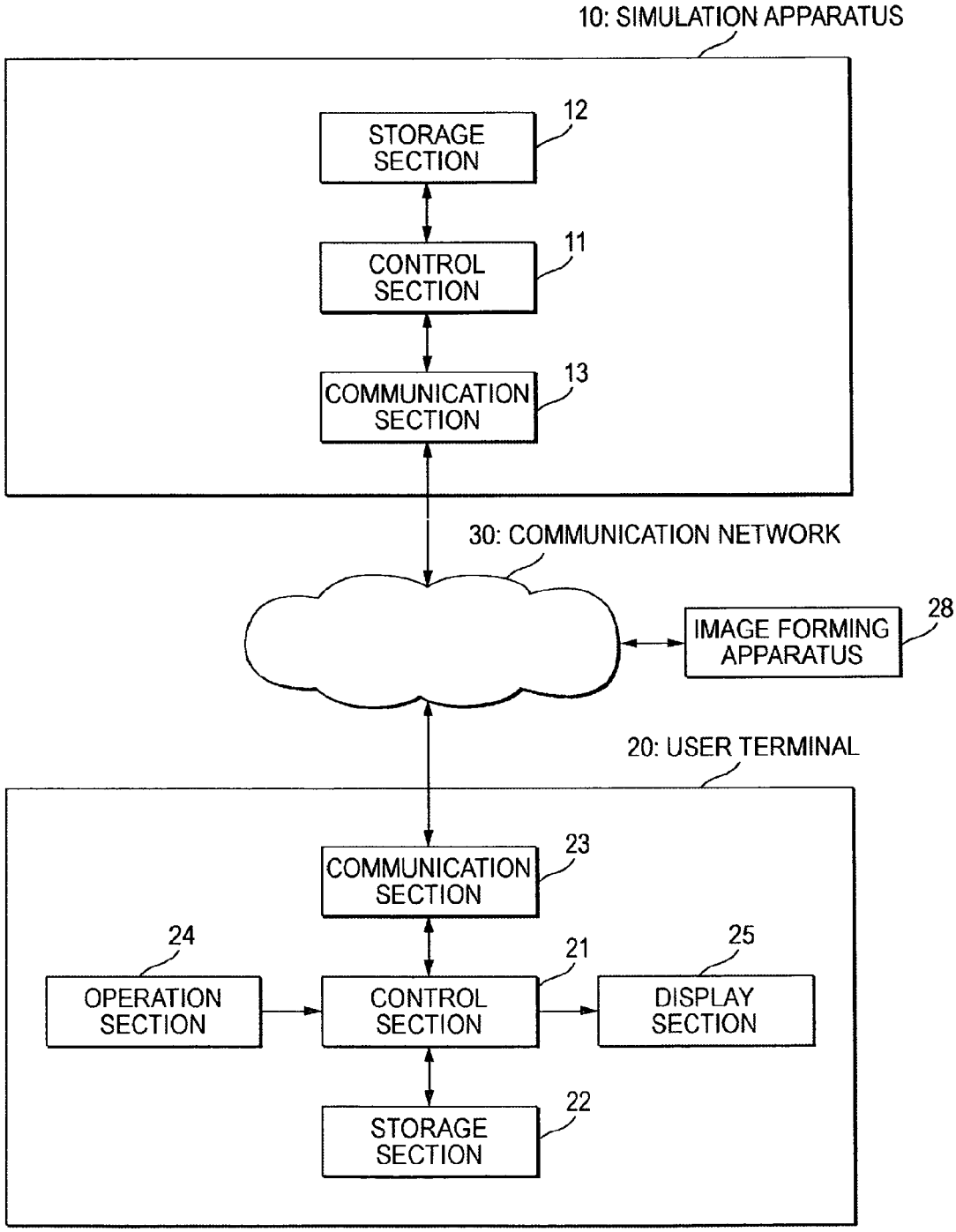
FIG. 1 is a general drawing to show the schematic configuration of a computer system including an image-forming-apparatus simulation apparatus according to one exemplary embodiment of the invention.

Referring to the accompanying drawings, exemplary embodiments of the invention will be described below. FIG. 1 is a general drawing to show the schematic configuration of a computer system including an image-forming-apparatus simulation apparatus according to one exemplary embodiment of the invention.

As shown in FIG. 1, in the exemplary embodiment, a simulation apparatus 10 and a user terminal 20 are connected so that they can conduct data communications with each other through a communication network 30. The communication network 30 may be a wide area network such as the Internet or may be a LAN (Local Area Network) such as an in-house intranet, for example. Further, the simulation apparatus 10 may be connected to an image forming apparatus 28 through the communication network 30 so as to be able to conduct data communications. In FIG. 1, the image forming apparatus 28 is connected directly to the communication network 30. However, for example, the image forming apparatus 28 may be connected to the user terminal 20 and may be connected to the simulation apparatus 10 through the user terminal 20 and the communication network 30 so as to be able to conduct data communications.

The simulation apparatus 10 is a general server computer, etc., for example, and is made up of a control section 11, a storage section 12, and a communication section 13. The simulation apparatus 10 corresponds to an image-forming-apparatus simulation apparatus in the invention. The simulation apparatus 10 executes simulation of processing executed by the image forming apparatus in response to a processing request transmitted from the user terminal 20 and outputs the simulation result to the user terminal 20.

By way of example, the simulation apparatus 10 functions as a Web application server for generating and transmitting Web page data in response to a request from the user terminal 20. That is, the simulation apparatus 10 transmits data of a Web page generated with a user interface for prompting the user to enter various pieces of information and information to be presented to the user as the simulation result to the user terminal 20, thereby executing simulation and outputting the simulation result.

The control section 11 of the simulation apparatus 10 is a CPU, etc., and operates in accordance with a program stored in the storage section 12. In the exemplary embodiment, the control section 11 executes simulation of processing executed by the image forming apparatus based on a request from the user terminal 20. An example of the processing executed by the control section 11 in the exemplary embodiment is described later in detail.

The storage section 12 is a computer-readable storage medium for storing a program executed by the control section 11 and is implemented as at least either of a memory device such as RAM or ROM and a disk device, etc. The storage section 12 also operates as work memory of the control section 11.

Further, in the exemplary embodiment, the storage section 12 of the simulation apparatus 10 stores a defective event table T. In the defective event table T, plural pieces of event specifying information each of which represents a defective event assumed to occur in the image forming apparatus 28 are associated with image correction rules each of which represents a method for simulating an influence of the defective event represented by corresponding event specifying information on an image formed by the image forming apparatus 28.

The defective events represented by the event specifying information are such various events, which may occur in the image forming apparatus 28 and influences an image formed by the image forming apparatus. Examples of the defective events include age degradation of a part such as a photoconductor drum, anomaly of a part such as a photoconductor drum, insufficient remaining amount of consumables such as toner, abnormal operation of the image forming apparatus caused by coagulation of a developer in a developing device or dirt on a fuser.

The image correction rule represents an image processing method for simulating influence of the defective event represented by the associated event specifying information, the influence assumed to appear on an image formed by the image forming apparatus 28. For example, examples of the image correction rule include a filter rule representing filter processing on the target image.

In the defective event table T, the event specifying information and the image correction rule may be associated with at least one piece of defect attribute information. The defect attribute information represents a defect attribute to which a defective event belongs. For example, the defective events may be classified according to types of influence appearing on an image formed by the image forming apparatus 28. Examples of the defect attributes include blur, dirt and misdrawing. Plural pieces of defect attribute information may be associated with one defective event.

By way of example, the defective event table T contains information as shown in FIG. 2. In the example shown in FIG. 2, a filter rule 1 and defect attribute information "blur" are associated with event specifying information "remaining amount of toner being insufficient." A filter rule 2 and two pieces of defect attribute information "blur" and "misdrawing" are associated with event specifying information "photoconductor drum degradation." Further, a filter rule 3 and two pieces of defect attribute information "blur" and "dirt" are associated with event specifying information "image quality sensor being stained."

The communication section 13 is a network card, etc., for example, and transmits information through the network 30 in accordance with a command from the control section 11. The communication section 13 receives information coming through the network 30 and outputs the information to the control section 11.

The user terminal 20 is a personal computer, etc., for example, and is made up of a control section 21, a storage section 22, a communication section 23, an operation section 24, and a display section 25. The user can cause the simulation apparatus 10 to execute simulation of the image forming apparatus by entering a command in the user terminal 20, and can check the result of the simulation executed by the simulation apparatus 10 by viewing information displayed on the display section 25 of the user terminal 20.

By way of example, for the simulation apparatus 10 to function as a Web application server, the user terminal 20 executes a Web browser program and displays Web page data output by the simulation apparatus 10 on the display section 25. This enables the user to enter various pieces of information required for execution of simulation on the Web page and check the simulation result on the Web page.

The control section 21 of the user terminal 20 is a CPU, etc., and operates in accordance with a program stored in the storage section 22. In the exemplary embodiment, the control section 21 outputs a simulation execution request to the simulation apparatus 10 in accordance with user's command entry operation through the operation section 24. The control section 21 also accepts the simulation execution result transmitted from the simulation apparatus 10 and displays the simulation result on the display section 25.

The storage section 22 is a computer-readable storage medium for storing a program executed by the control section 21 and is implemented as at least either of a memory device such as RAM or ROM and a disk device, etc. The storage section 22 also operates as work memory of the control section 21.

The communication section 23 is a network card, etc., for example, and transmits information through the network 30 in accordance with a command from the control section 21. The communication section 23 receives information coming through the network 30 and outputs the information to the control section 21.

The operation section 24 is a keyboard, a mouse, etc., for example, and accepts user's command entry operation and outputs the description of the command entry operation to the control section 21. The display section 25 is a display, etc., for example, and displays information in accordance with a command from the control section 21.

The image forming apparatus 28 is an image forming apparatus to be simulated by from the simulation apparatus 10 and is a printer, a copier, etc., for example. The image forming apparatus 28 forms on a recording medium, target image data acquired by receiving the data from the computer of the user terminal, etc., or reading an image formed on a recording medium such as paper, for example.

Figure 3:
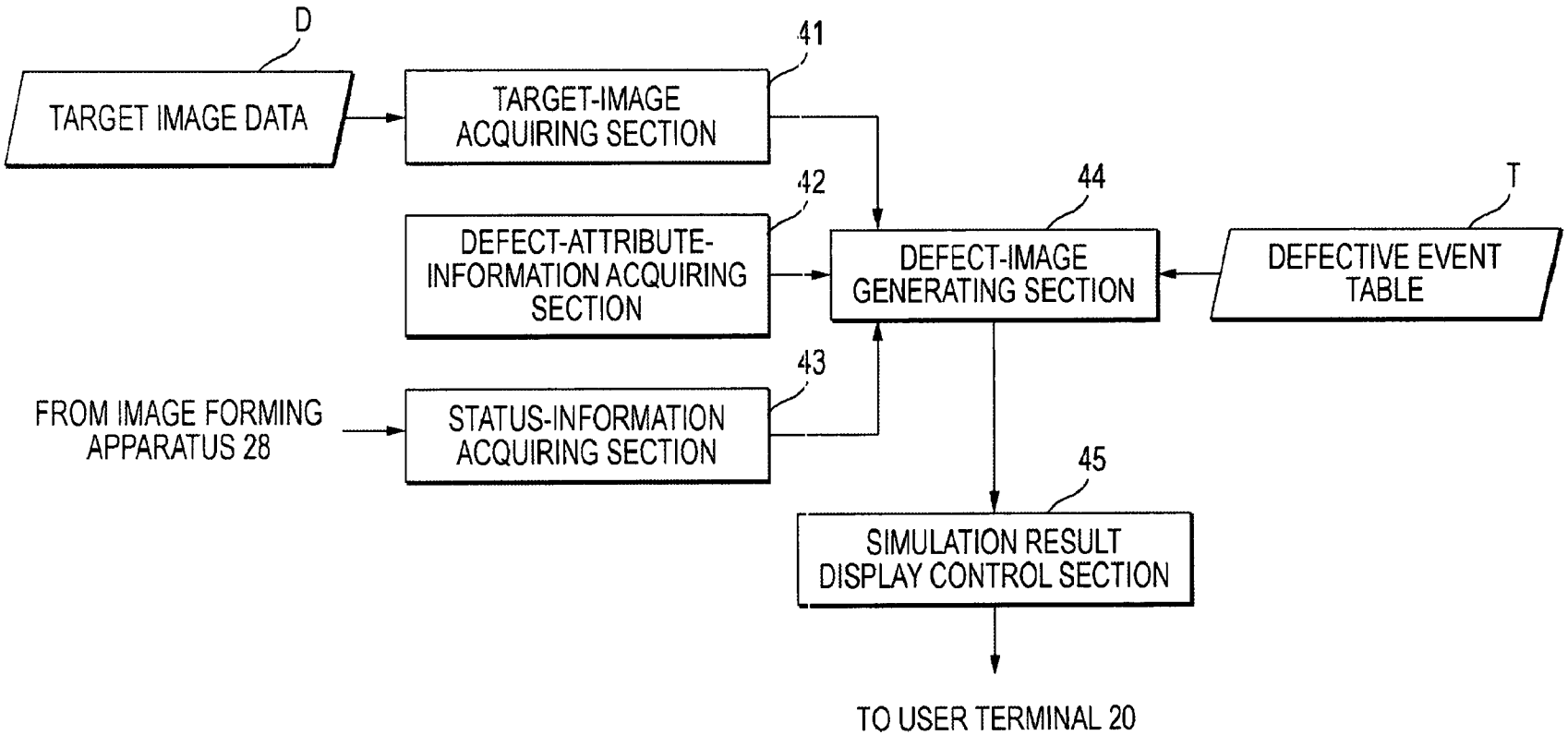
FIG. 3 is a functional block diagram to show functions of the image-forming-apparatus simulation apparatus according to the exemplary embodiment of the invention.

Next, the functions implemented by the simulation apparatus 10 in the exemplary embodiment will be discussed. The simulation apparatus 10 is functionally made up of a target-image acquiring section 41, a defect-attribute-information acquiring section 42, a status-information acquiring section 43, a defect-image generating section 44, and a simulation result display control section 45, as shown in FIG. 3. The functions are implemented as the control section 11 executes the programs stored in the storage section 11, for example.

The target-image acquiring section 41 acquires target image data D to which image formation processing of the image forming apparatus 28 is applied. The target-image acquiring section 41 can acquire an image formation instruction described in a PDL (Page Description Language), etc., for example, for causing the image forming apparatus 28 to execute image formation, thereby acquiring the target image data D contained in the image formation instruction.

As specific examples, the target-image acquiring section 41 acquires the target image data D according to the following illustrated methods:

The first example to be discussed is an example wherein the target image data D generated in the user terminal 20 is transmitted from the user terminal 20 to the simulation apparatus 10 as the user enters a command through the operation section 24, whereby the target-image acquiring section 41 acquires the target image data D. In this case, for example, the user gets a printer driver program to generate the target image data D by downloading the program from a web server, etc., (which may be the simulation apparatus 10) or in any other manner and installs the printer driver program in the user terminal 20. Next, the user causes the user terminal 20 to execute an application program and enters a print execution command together with specification of the use of the printer driver program. Accordingly, the control section 21 of the user terminal 20 executes the printer driver program and generates an image formation instruction containing the target image data D. Further, the user enters a command of uploading the target image data D on the Web page displayed on the display section 25 with specification of the generated image formation instruction. Accordingly, the user transmits the image formation instruction containing the target image data D to the simulation apparatus 10 and the target-image acquiring section 41 accepts the transmitted image formation instruction, thereby acquiring the target image data D.

According to the first example, the user needs to generate the target image data D required for simulation and then further enter an upload command; time and labor are required. Then, the user terminal 20 may transmit the target image data D generated in the user terminal 20 to the simulation apparatus 10 as it is. This case will be discussed below as the second example:

In the second example, the user installs a printer driver program in the user terminal 20 and enters a print command through an application program as in the first example. The control section 21 of the user terminal 20 executes the printer driver program, generates an image formation instruction containing the target image data D, and outputs the image formation instruction to a virtual printer port. The image formation instruction output to the virtual printer port is transmitted to the simulation apparatus 10 through the communication network 30. Accordingly, the target-image acquiring section 41 accepts the transmitted image formation instruction, thereby acquiring the target image data D.

In the first and second examples described above, to execute the printer drive program and generate the image formation instruction containing the target image data D, the control section 21 may reference predetermined setup information to generate the image formation instruction. For example, to generate an image formation instruction given to the image forming apparatus 28, the control section 21 references setup information referenced by the printer drive program for the image forming apparatus 28 and generates the image formation instruction. Accordingly, the image formation instruction acquired by the target-image acquiring section 41 becomes an instruction based on similar conditions to those of an image formation instruction output by the user terminal 20 to the image forming apparatus 28 as for setup information of the paper size, margin setting, etc., for example. The defect-image generating section 44 (described later) generates defect-image data using the setup information, whereby the generated defect-image data becomes close to the image actually formed on a recording medium by the image forming apparatus 28.

In both the first and second examples described above, the user needs to get the printer driver program and install the printer driver program in the user terminal 20; time and labor are required. Then, for example, the user terminal 20 may transmit application data generated by executing an application program based on user's command entry operation to the simulation apparatus 10 as it is, and the simulation apparatus 10 may generate target image data D. This case will be discussed below as the third example:

In the third example, the user enters a command of uploading application data representing the image to which image formation of the image forming apparatus 28 was applied on the Web page displayed on the display section 25, for example. Accordingly, the user terminal 20 transmits the application data to the simulation apparatus 10. The control section 11 of the simulation apparatus 10 accepting the application data executes predetermined processing responsive to the application data type and generates the target image data D corresponding to the image forming apparatus 28. Accordingly, the target-image acquiring section 41 can acquire the target image data D without the time or labor of the user. In the third example, however, the simulation apparatus 10 needs to include image formation instruction generation mean for performing predetermined processing responsive to the type of application data to be simulated by the user and generating the target image data D based on the application data.

Alternatively, the target-image acquiring section 41 may acquire the target image data D by accepting an image formation instruction transmitted from the image forming apparatus 28. This case will be discussed below as the fourth example:

In the fourth example, the image forming apparatus 28 temporarily stores an image formation instruction received from the user terminal 20, etc., in a storage section of a hard disk, etc., (not shown) included in the image forming apparatus 28. For example, if the image forming apparatus 28 receives a new image formation instruction or accepts a control instruction for deleting the stored image formation instruction, the image forming apparatus 28 deletes the stored image formation instruction. On the other hand, if the user enters a command of transmitting an image formation instruction through an operation section of an operation panel, etc., (not shown), the image forming apparatus 28 transmits the stored image formation instruction to the simulation apparatus 10. The target-image acquiring section 41 can acquire the target image data D by accepting the transmitted image formation instruction. In the example, various setup pieces of information used by the image forming apparatus 28 actually executing the image formation processing, contained in the image formation instruction can be acquired together with the target image data D.

The target-image acquiring section 41 acquires the target image data D generated based on the application data stored in the user terminal 20 according to any of the described example methods.

The target-image acquiring section 41 may store the acquired target image data D in the storage section 12. In this case, to execute the next or later simulation, the target-image acquiring section 41 can acquire the target image data D used as the processing target at the preceding simulation execution time and stored in the storage section 12 in response to a command of the user. Accordingly, to execute simulation several times by changing the simulation execution conditions of designated attribution information, index information, etc., described later, the user can be saved from having to enter a command, etc.

The defect-attribute-information acquiring section 42 acquires, based on user's designation, defect attribute information representing an attribute to which a defect image to be generated by the defect-image generating section 44 belongs as designated attribution information. In addition, the defect-attribute-information acquiring section 42 may acquire index information representing a defect degree involved in the defect attribute represented by the designated attribution information together with the designated attribution information. In this case, the defect-attribute-information acquiring section 42 may acquire plural pieces of defect attribute information as the designated attribution information. If plural pieces of defect attribute information are acquired as the designated attribution information, plural pieces of index information may be acquired in a one-to-one correspondence with the plural pieces of defect attribute information.

Figure 4:
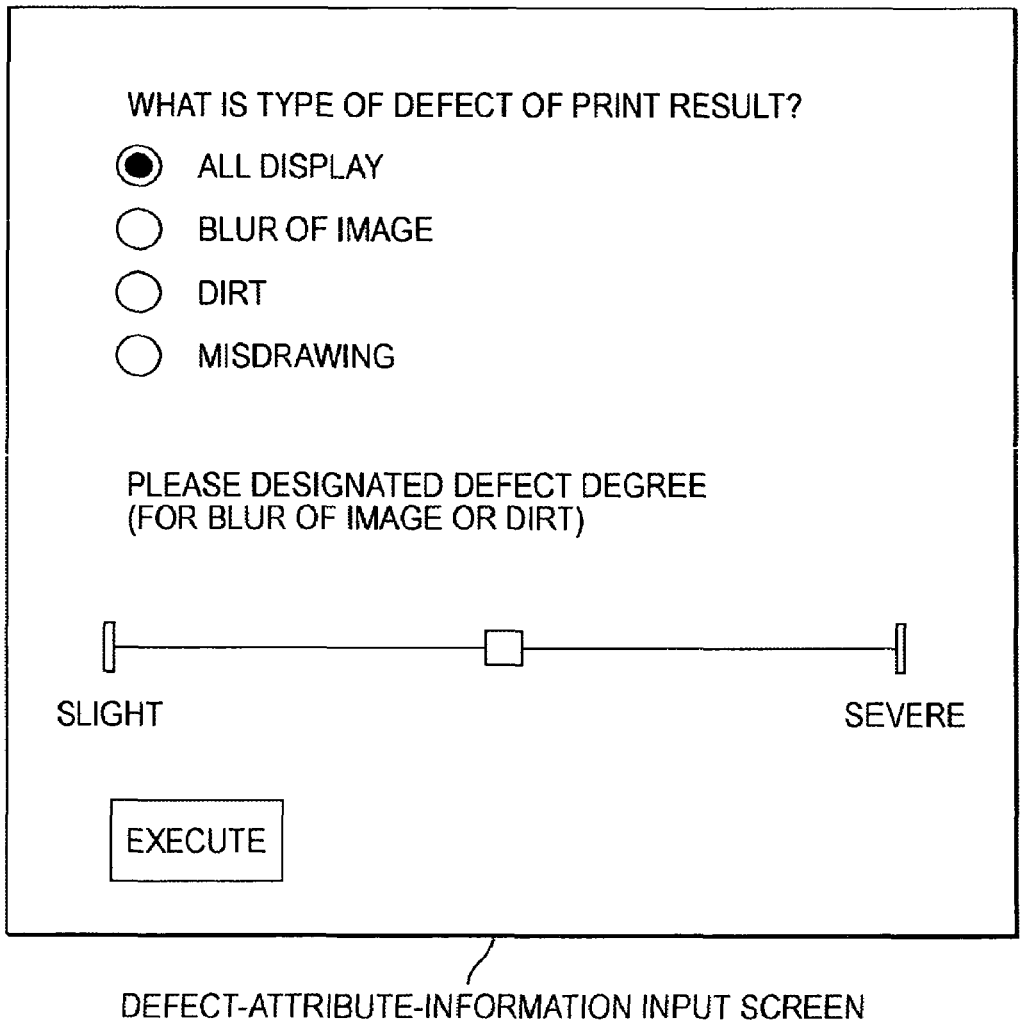
FIG. 4 is a schematic representation to show an example of a defect-attribute-information input screen displayed on a user terminal.

By way of example, the defect-attribute-information acquiring section 42 outputs Web page data representing a defect-attribute-information input screen as shown in FIG. 4 for displaying the defect-attribute-information input screen on the display section 25 of the user terminal 20. The user selects designated attribution information by entering a command through the operation section 24. The user also enters index information by operating a slide bar. The user terminal 20 transmits the designated attribution information and the index information through the communication network 30 to the simulation apparatus 10 in response to a command entered by the user pressing a determination button on the screen. The defect-attribute-information acquiring section 42 acquires the designated attribution information and the index information by accepting the transmitted information.

The status-information acquiring section 43 acquires status information indicating a status of the image forming apparatus 28 from the image forming apparatus 28. The status information may relate to a remaining amount of consumable such as toner and/or previous replacement date and time of each part. The status information may contain information relating to an error occurrence history, an image formation execution history and/or a history of the total number of printed recording media.

The status-information acquiring section 43 acquires the status information, for example, as follows: When the image formation instruction stored by the image forming apparatus 28 is transmitted to the simulation apparatus 10 based on user's command entry operation, the status information is transmitted together. Accordingly, the status-information acquiring section 43 accepts the received information and acquires the status information. Alternatively, the status-information acquiring section 43 may acquire information of the network address, etc., of the image forming apparatus 28 based on specification of the user from the user terminal 20 or the like, transmit a status information transmission request to the image forming apparatus 28 for commanding the image forming apparatus 28 to transmit status information, and accept the status information transmitted by the image forming apparatus 28 in response to the status information transmission request, thereby acquiring the status information.

The defect-image generating section 44 executes image processing based on the image correction rule on the target image data D acquired by the target-image acquiring section 41, to generate defect-image data representing a defect image expected to be formed on a recording medium by the image forming apparatus 28 when a defective event, which is represented by the event specifying information associated with the image correction rule, occurs.

The defect-image generating section 44 selects an image correction rule used to generate defect-image data as a selected image correction rule in the following manner. For example, the defect-image generating section 44 may select all image correction rules contained in the defective event table T as the selected image correction rules. Alternatively, the defect-image generating section 44 may select an image correction rule from among the image correction rules contained in the defective event table T in accordance with the designated attribute information acquired by the defect-attribute-information acquiring section 42 and/or the status information acquired by the status-information acquiring section 43.

For example, the defect-image generating section 44 selects the image correction rule associated with the designated attribute information acquired by the defect-attribute-information acquiring section 42 from the defective event table T, as the selected image correction rule. As a specific example, if the user designates "dirt" as the designated attribute information from the defective event table T in FIG. 2, the defect-image generating section 44 selects the filter rule 3, which is the image correction rule associated with the defect attribute information "dirt," as the selected image correction rule, while excluding the filter rules 1 and 2 from selection targets. The selected image correction rule is thus selected in accordance with the designated attribute information, whereby the defect-image generating section 44 can generate the defect-image data in accordance with the defective event belonging to the attribute designated by the user. That is, for example, if the user designates "dirt" as the designated attribute information, the defect-image generating section 44 generates defect-image data expected to be formed by the image forming apparatus 28 according to various defective events associated with "dirt."

The defect-image generating section 44 may select an image correction rule satisfying a predetermined condition based on the status information acquired by the status-information acquiring section 43. Alternatively, the defect-image generating section 44 may exclude an image correction rule satisfying a predetermined condition from the selected image correction rules based on the status information.

The event specifying information and the image correction rules contained in the defective event table T may be associated not only with the defect attribute information, but also with status attribute information representing an attribute relating to a status of the image forming apparatus 28. In this case, the defect-image generating section 44 may determine the status attribute information representing the status to which the image forming apparatus 28 belongs, based on the status information acquired by the status-information acquiring section 43. Then, the defect-image generating section 44 may select the image correction rule associated with the determined status attribute information, as the selected image correction rule.

For example, if it is predicted that the photoconductor drum will be degraded, from information concerning the total number of printed recording media and the photoconductor drum replacement history, it is desirable that defect-image data responsive to a defective event relevant to the photoconductor drum should be generated. Then, the image correction rule responsive to the defective event of "photoconductor drum deterioration" associated with the status attribute information of "photoconductor drum" is selected as the selected image correction rule.

Further, the defect-image generating section 44 may correct the selected image correction rule based on the index information acquired by the defect-attribute-information acquiring section 42 and the status information acquired by the status-information acquiring section 43, to generate defect-image data based on the corrected image correction rule.

For example, it is assumed that the defect-attribute-information acquiring section 42 acquires "blur" as the designated attribute information and acquires a value representing a degree of blur as the index information associated with the designated attribute information. In this case, the defect-image generating section 44 corrects the selected image correction rule associated with the defect attribute information "blur" based on the acquired index information to generate the corrected image correction rule. For example, the defect-image generating section 44 performs calculation to correct correction parameters used in the selected image correction rule based on the value represented by the index information, to thereby correct the selected image correction rule.

Since the defect-image generating section 44 generates the defect-image data based on the corrected image correction rule, the defect-image generating section 44 may generate the defect-image data with severe degree of blur or dirt in accordance with the value of the index information. In contrast, the defect-image generating section 44 may generate the defect-image data with almost no blur or dirt in accordance with the value of the index information.

The defect-image generating section 44 may generate the corrected image correction rule based on the status information. For example, the defect-image generating section 44 corrects the selected image correction rule associated with the defective event relating to a toner among the selected image correction rules, based on a value representing the remaining amount of toner contained in the status information.

Further, the defect-image generating section 44 may combine plural image correction rules to generate a new image correction rule. For example, the defect-image generating section 44 generates a new image correction rule (composite image correction rule) based on plural image correction rules associated with common defect attribute information among the selected image correction rules and adds the composite image correction rule to the selected image correction rules. The composite image correction rule is used to simulate an influence on the formed image when plural defective events occur at the same time in the image forming apparatus 28. As a specific example, the composite image correction rule represents image processing of performing filtering represented by plural filter rules for the target image in order, for example.

A specific example of processing of generating defect-image data by the defect-image generating section 44 based on an image correction rule will be described. In this case, the defect-image generating section 44 first simulates processing, which is executed by the image forming apparatus 28, on target image data D, and generates image data representing an image expected to be formed on a recording medium when no defective event occurs (normal image data). Then, the defect-image generating section 44 executes image correction processing on the normal image data based on the image correction rule to generate defect-image data.

First, the defect-image generating section 44 performs on the target image data D image formation simulation processing for simulating image formation processing, which is executed by the image forming apparatus 28. Accordingly, the defect-image generating section 44 generates the normal image data expected to be output by the image forming apparatus 28. For example, if the image forming apparatus 28 includes image formation means for forming an image on a recording medium using four color toners of cyan (C), magenta (M), yellow (Y), and black (K), the normal image data is image data represented by four component colors of C, M, Y, and K, provided by executing color conversion processing, etc., considering the gradation characteristic of the image formation means for the target image data D. If the normal image data made up of the four component colors cannot be generated because the data format of the target image data D is invalid or the like, the defect-image generating section 44 performs error handling in such a manner that it outputs an error message and terminates the processing, for example.

Next, the defect-image generating section 44 performs on the normal image data image correction processing for making an image correction based on the selected image correction rule, to thereby generate defect-image data corresponding to each selected image correction rule. Specifically, filtering based on the filter rule represented by the selected image correction rule is executed for the normal image data, for example. If a correction is made to the selected image correction rule as described above, the image correction processing is performed using the corrected image correction rule.

Finally, the defect-image generating section 44 converts the defect-image data generated by performing the above-described processing into image data in a predetermined data format such as a bit map format that can be displayed on the display section 25 of the user terminal 20, and outputs the converted image data to the simulation result display control section 45.

The simulation result display control section 45 performs display control processing of displaying the defect-image data generated by the defect-image generating section 44 on the display section 25 together with the event specifying information associated with the image correction rule used for generating the defect-image data. Specifically, the simulation result display control section 45 generate Web page data with the defect-image data and the event specifying information placed side by side and outputs the Web page data to the user terminal 20, for example. Then, the control section 21 of the user terminal 20 displays the accepted Web page data on the display section 25.

Figure 5:
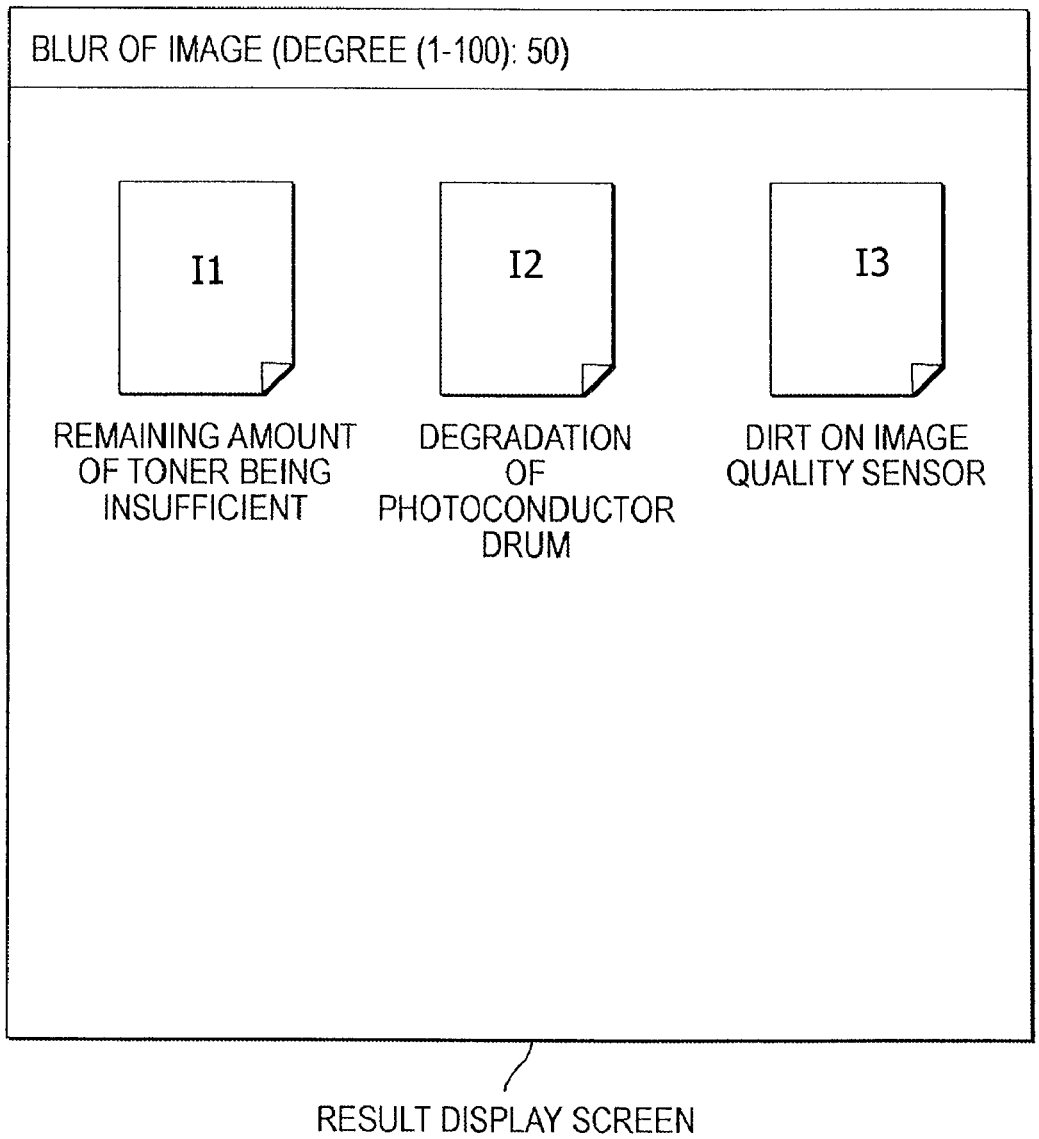
FIG. 5 is a schematic representation to show an example of a result display screen displayed on the user terminal.

By way of example, the simulation result display control section 45 displays a result display screen as illustrated in FIG. 5 on the display section 25. Here, the designated attribute information and the index information designated by the user are displayed on the top of the screen and reduced images representing plural pieces of the defect-image data generated by the defect-image generating section 44 are displayed side by side together with the event specifying information associated with the image correction rules used for generating the pieces of the defect-image data. Specifically, the result display screen contains the reduced images corresponding to a defect image I1 assumed to be formed if insufficient toner remaining amount occurs in the image forming apparatus 28, a defect image I2 assumed to be formed at the photoconductor drum deterioration time, and a defect image I3 assumed to be formed when the image quality sensor is stained. The original size images representing the defect-image data may be displayed on the display section 25 in response to a reduced image selection command entered by the user, for example, in a state in which the result display screen is displayed on the display section 25.

If the image forming apparatus 28 forms an image with a blur on a recording medium, the user can cause the simulation apparatus 10 to execute simulation with "blur" specified as the designated attribute information, thereby reading (viewing) the result display screen as illustrated in FIG. 5. For example, if the image with a blur close to the actually formed image is the defect image I2 among the generated defect images I1, I2, and I3, it can be estimated that a defective event of degradation of the photoconductor drum may occur in the image forming apparatus 28.

If the image correction rule used for generating the defect-image data is a composite image correction rule generated based on plural image correction rules, the simulation result display control section 45 displays composite event specifying information generated by combining the pieces of event specifying information associated with the plurality of image correction rules together with the defect-image data. In the example of the defective event table T illustrated in FIG. 2, the defect-image generating section 44 generates the defect-image data according to the composite image correction rule generated based on filter rules 1 and 2, the simulation result display control section 45 displays information of "insufficient toner remaining amount+photoconductor drum degradation" or the like as the composite event specifying information together with the defect-image data.

Figure 6:
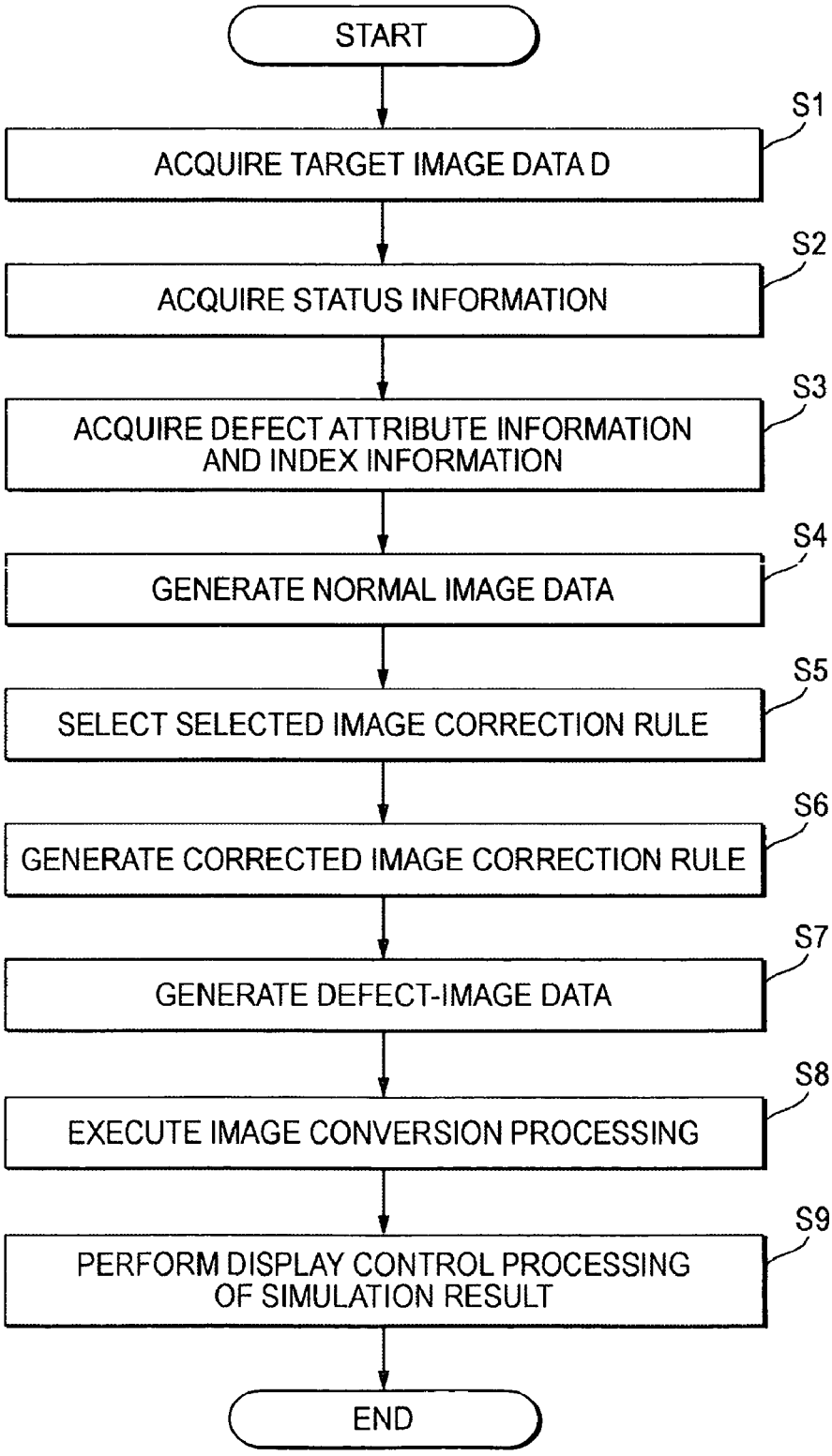
FIG. 6 is a flowchart to show an example of processing executed by the image-forming-apparatus simulation apparatus according to the exemplary embodiment of the invention.

Next, a general flow example of processing of executing simulation by the simulation apparatus 10 in the exemplary embodiment will be discussed based on a flowchart of FIG. 6.

To begin with, the image forming apparatus 28 transmits the currently stored image formation instruction to the simulation apparatus 10 based on user's command entry operation. By accepting the image formation instruction, the target-image acquiring section 41 acquires target image data D (S1). Here, the target-image acquiring section 41 may acquire plural pieces of target image data D. In this case, the subsequent processing may be executed for the pieces of target image data D or may be executed for the representative image data selected from among the plural pieces of target image data D (for example, the image data of the first page among the plural pieces of target image data D contained in the image formation instruction).

Next, the status-information acquiring section 43 acquires the status information of the image forming apparatus 28 based on the information transmitted by the image forming apparatus 28 (S2). Subsequently, the defect-attribute-information acquiring section 42 acquires defect attribute information and index information based on user's command entry operation in the user terminal 20 (S3).

Next, the defect-image generating section 44 starts generation processing of defect-image data. First, the defect-image generating section 44 executes simulation of the image formation processing executed by the image forming apparatus 28 for the target image data D acquired at S1, thereby generating normal image data (S4).

Next, the defect-image generating section 44 selects the selected image correction rule used for generating defect-image data from among the image correction rules stored in the defective event table T based on the defect attribute information acquired by the defect-attribute-information acquiring section 42 at S3 and the status information acquired by the status-information acquiring section 43 at S2 (S5). Further, the defect-image generating section 44 makes an image correction rule correction to at least a part of the selected image correction rule at S5 based on the index information acquired by the defect-attribute-information acquiring section 42 (S6).

Subsequently, the defect-image generating section 44 executes image correction processing for the normal image data generated at S4 based on the selected image correction rule at S5 or the corrected image correction rule at S6 and generates defect-image data (S7). Further, the defect-image generating section 44 performs image conversion processing of converting the defect-image data generated at S7 into an image in a predetermined data format (S8).

Subsequently, the simulation result display control section 45 performs display control processing of displaying the simulation result on the display section 25 of the user terminal 20 (S9). Specifically, the simulation result display control section 45 displays the defect-image data provided at S8 and the event specifying information representing the defective event associated with the selected image correction rule side by side on the display section 25.

According to the exemplary embodiment described above, if an adverse effect occurs on the formed image because of a defect occurring in the image forming apparatus 28, the user can cause the simulation apparatus 10 to execute simulation of generating defect-image data representing a defect image assumed to be formed in response to the defective event, thereby estimating the occurring defective event using the result of the simulation. According to the exemplary embodiment, even if the image forming apparatus 28 does not defect an anomaly, if an adverse effect occurs on the formed image, the defective event can be estimated from the adverse effect. Simulation is executed using the target image data D used to actually form the image by the user, whereby a defect image close to the image actually formed on the recording medium can be generated by the simulation. Accordingly, it is made possible for the user to easily compare the actual problem formed image with the image presented by the simulation apparatus 10 unlike the case where a defect image based on sample data provided by the manufacturer is presented, for example.

It is to be understood that the invention is not limited to the exemplary embodiment described above and can be embodied as various modifications and changes. For example, in the description given above, the user enters a command in the user terminal 20 different from the simulation apparatus 10 and checks the simulation result on the user terminal 20, but the function executed by the simulation apparatus 10 and the function executed by the user terminal 20 may be provided in one computer. Alternatively, the function executed by the simulation apparatus 10 may be provided as a plurality of computers cooperate. For example, the image-forming-apparatus simulation apparatus according to one exemplary embodiment of the invention may be made up of a front-end server for outputting a Web page to be displayed on the user terminal 20 and receiving information transmitted from the user terminal 20 and a back-end server for executing simulation of processing executed by the image forming apparatus 28 and generating defect-image data.

In the description given above, the function executed by the user terminal 20 may be provided by the image forming apparatus 28. In this case, the display means of the display, etc., included in the image forming apparatus 28 displays the result display screen representing the simulation result. Accordingly, if the image forming apparatus 28 forms a problem image on a recording medium, immediately the user can enter a command given to the image forming apparatus 28, thereby transmitting an image formation instruction to the simulation apparatus 10 and checking the simulation result on the spot.

The simulation apparatus 10 may execute simulation for a plurality of image forming apparatus. In this case, for example, the simulation apparatus 10 has a plurality of defect-image generating sections 44 and a plurality of defective event tables T for generating defect-image data responsive to each image forming apparatus. The simulation apparatus 10 selects the defect-image generating section 44 for simulation based on user's specification of the image forming apparatus to be simulated, etc., and the selected defect-image generating section 44 references the information contained in the corresponding defective event table T and generates defect-image data. Accordingly, defect-image data responsive to defective events occurring in various image forming apparatus can be generated. In this case, of image correction rules contained in the defective event tables T, those associated with defective events with formed images involving no difference between models, the common image correction rule in the corresponding defective event tables T associated with the models may be used.

The simulation apparatus 10 may acquire information concerning the hardware configuration of additional options, etc., of the image forming apparatus 28, information concerning the software of setup information, etc., concerning the operation conditions, etc., as initial information based on the user's command entry operation through the operation section 24 or the like. The defect-image generating section 44 executes image formation simulation processing based on the acquired initial information, whereby the simulation apparatus 10 can generate the defect-image data representing a defect image closer to the image formed actually by the image forming apparatus 28.

To transmit an image formation instruction containing target image data D, application data, etc., to the simulation apparatus 10, the user terminal 20 or the image forming apparatus 28 may encrypt the instruction, the data, etc., according to a predetermined method for transmission. In this case, the target-image acquiring section 41 decrypts the received data, thereby acquiring the target image data D.

Accordingly, the risk of information leakage concerning the target image data D on the communication network 30 can be decreased and if a problem arises in the image containing secret information, the user can also cause the simulation apparatus 10 to generate defect-image data.

The foregoing description of the exemplary embodiments of the invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image-forming-apparatus simulation apparatus comprising:

a storing section that stores a defective event table in which plural pieces of event specifying information, each of which represents a defective event relating to an image forming apparatus, are associated with a plurality of image correction rules, each of which represents a method for simulating an influence of a defective event represented by corresponding event specifying information on an image formed by the image forming apparatus;

a first acquiring section that acquires target image data;

a generating section that selects at least one of the image correction rules stored in the storing section, the generating section executes image processing on the acquired target image data based on the selected image correction rule to generate defect-image data representing a defect image expected to be formed on a recording medium by the image forming apparatus when the defective event, which is represented by event specifying information associated with the selected image correction rule, occurs;

a display section; and a control section that displays the generated defect-image data on the display section together with the event specifying information associated with the selected image correction rule.

2. The simulation apparatus according to claim 1 wherein:

the generating section simulates processing, which is executed by the image forming apparatus on the acquired target image data, to generate normal image data representing an image expected to be formed on a recording medium if any defective event does not occur, and the generating section executes image correction processing on the normal image data based on the selected image correction rule to generate the defect-image data.

3. The simulation apparatus according to claim 2, further comprising:

a second acquisition section that acquires at least one of plural pieces of defect attribute information, each of which represents an attribute to which a corresponding defect event belongs, based on user's designation, wherein:

the defective event table includes the plural pieces of event specifying information, the plurality of image correction rules and the plural pieces of defect attribute information in association with each other, and the generating section selects the at least one image correction rule, which is associated with the acquired defect attribute information, and generates the defect-image data based on the selected image correction rule.

4. The simulation apparatus according to claim 3, wherein:

the second acquiring section further acquires index information, which indicates a degree of a defect involved in the attribute represented by the acquired defect attribute information, and the generating section corrects the selected image correction rule according to the acquired index information and generates the defect-image data based on the corrected image correction rule.

5. The simulation apparatus according to claim 4, further comprising:

a third acquiring section connected to the image forming apparatus, the third acquiring section that acquires status information representing a status of the image forming apparatus from the image forming apparatus, wherein:

the generating section selects the at least one image correction rule in accordance with the acquired status information and generates the defect-image data based on the selected image correction rule.

6. The simulation apparatus according to claim 3, further comprising:

a third acquiring section connected to the image forming apparatus, the third acquiring section that acquires status information representing a status of the image forming apparatus from the image forming apparatus, wherein:

the generating section selects the at least one image correction rule in accordance with the acquired status information and generates the defect-image data based on the selected image correction rule.

7. The simulation apparatus according to claim 2, further comprising:

a second acquiring section connected to the image forming apparatus, the third acquiring section that acquires status information representing a status of the image forming apparatus from the image forming apparatus, wherein:

the generating section selects the at least one image correction rule in accordance with the acquired status information and generates the defect-image data based on the selected image correction rule.

8. The simulation apparatus according to claim 1, further comprising:

a second acquisition section that acquires at least one of plural pieces of defect attribute information, each of which represents an attribute to which a corresponding defect event belongs, based on user's designation, wherein:

the defective event table includes the plural pieces of event specifying information, the plurality of image correction rules and the plural pieces of defect attribute information in association with each other, and the generating section selects the at least one image correction rule, which is associated with the acquired defect attribute information, and generates the defect-image data based on the selected image correction rule.

9. The simulation apparatus according to claim 8, further comprising:

a third acquiring section connected to the image forming apparatus, the third acquiring section that acquires status information representing a status of the image forming apparatus from the image forming apparatus, wherein:

the generating section selects the at least one image correction rule in accordance with the acquired status information and generates the defect-image data based on the selected image correction rule.

10. The simulation apparatus according to claim 1, further comprising:

a second acquiring section connected to the image forming apparatus, the third acquiring section that acquires status information representing a status of the image forming apparatus from the image forming apparatus, wherein:

the generating section selects the at least one image correction rule in accordance with the acquired status information and generates the defect-image data based on the selected image correction rule.

11. An image-forming-apparatus simulation apparatus comprising:

a storing section that stores a defective event table in which plural pieces of event specifying information, each of which represents a defective event relating to an image forming apparatus, are associated with a plurality of image correction rules, each of which represents a method for simulating an influence of a defective event represented by corresponding event specifying information on an image formed by the image forming apparatus;

a first acquiring section that acquires target image data;

a generating section that selects at least one of the image correction rules stored in the storing section, the generating section executes image processing on the acquired target image data based on the selected image correction rule to generate defect-image data representing a defect image expected to be formed on a recording medium by the image forming apparatus when the defective event, which is represented by event specifying information associated with the selected image correction rule, occurs;

a display section;

a control section that displays the generated defect-image data on the display section together with the event specifying information associated with the selected image correction rule; and a second acquisition section that acquires at least one of plural pieces of defect attribute information, each of which represents an attribute to which a corresponding defect event belongs, based on user's designation, wherein:

the defective event table includes the plural pieces of event specifying information, the plurality of image correction rules and the plural pieces of defect attribute information in association with each other, the generating section selects the at least one image correction rule, which is associated with the acquired defect attribute information, and generates the defect-image data based on the selected image correction rule, the second acquiring section further acquires index information, which indicates a degree of a defect involved in the attribute represented by the acquired defect attribute information, and the generating section corrects the selected image correction rule according to the acquired index information and generates the defect-image data based on the corrected image correction rule.

12. The simulation apparatus according to claim 11, further comprising:

a third acquiring section connected to the image forming apparatus, the third acquiring section that acquires status information representing a status of the image forming apparatus from the image forming apparatus, wherein:

the generating section selects the at least one image correction rule in accordance with the acquired status information and generates the defect-image data based on the selected image correction rule.

13. A method for simulating an image forming apparatus, the method comprising:

selecting at least one of a plurality of image correction rules, which are associated with plural pieces of event specifying information representing defect events relating to the image forming apparatus, wherein each of the image correction rules represents a method for simulating an influence of the defective event represented by corresponding event specifying information on an image formed by the image forming apparatus; and executing image processing on target image data based on the selected image correction rule to generate defect-image data representing a defect image expected to be formed on a recording medium by the image forming apparatus when the defective event, which is represented by event specifying information associated with the selected image correction rule, occurs.

14. The method according to claim 13, further comprising:

displaying the generated defect-image data together with the event specifying information associated with the selected image correction rule.

15. The method according to claim 13, further comprising:

storing a defective event table including the plural pieces of event specifying information and the plurality of image correction rules in association with each other; and acquiring the target image data.

16. A computer readable medium storing a program causing a computer to execute a process for simulating an image forming apparatus, the process comprising:

selecting at least one of a plurality of image correction rules, which are associated with plural pieces of event specifying information representing defect events relating to the image forming apparatus, wherein each of the image correction rules represents a method for simulating an influence of the defective event represented by corresponding event specifying information on an image formed by the image forming apparatus; and executing image processing on target image data based on the selected image correction rule to generate defect-image data representing a defect image expected to be formed on a recording medium by the image forming apparatus when the defective event, which is represented by event specifying information associated with the selected image correction rule, occurs.

17. The medium according to claim 16, further comprising:

displaying the generated defect-image data together with the event specifying information associated with the selected image correction rule.

18. The method according to claim 16, further comprising:

storing a defective event table including the plural pieces of event specifying information and the plurality of image correction rules in association with each other; and acquiring the target image data.

* * * * *